US006247657B1

(12) United States Patent
Finney, Jr. et al.

(10) Patent No.: US 6,247,657 B1
(45) Date of Patent: Jun. 19, 2001

(54) POWER GUN SPRAY NOZZLE AND METHOD

(75) Inventors: Thomas M. Finney, Jr.; William H. Kean, both of Flushing, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/323,001

(22) Filed: May 28, 1999

(51) Int. Cl.[7] ..... B05B 5/00

(52) U.S. Cl. ..... 239/690.1; 239/461; 239/499; 239/504

(58) Field of Search ..... 239/461, 499, 239/504, 505, 518, 124, 690, 690.1, 693, 706, 708, 600, 596, 525, 526, 548, 550, 494, 540, 1, 697, 698, 704, 705, 707, 3; 118/621

(56) References Cited

U.S. PATENT DOCUMENTS 1,895,307 * 1/1933 Beck ..... 239/548
4,072,129 * 2/1978 Bright et al. ..... 239/697
4,212,266 * 7/1980 Payne et al. ..... 239/693
5,351,903 * 10/1994 Mazakas et al. ..... 239/705
5,947,390 * 9/1999 Smith ..... 239/596

OTHER PUBLICATIONS

Fundamentals Of Powder Coating, by Society Of Manufacturing Engineers, pp. 1–36. (No Date).

* cited by examiner

*Primary Examiner*—Lisa Ann Douglas
(74) *Attorney, Agent, or Firm*—Margaret A. Dobrowitsky

(57) ABSTRACT

The development pertains to a powder gun spray nozzle (10) comprising a nozzle capable of attaching to a powder spray gun (20) having a center hole (16) and an inner (14) and an outer ring (12) of spaced apart holes in the nozzle, each hole of the inner ring being spaced equidistant from each other and each hole of the outer ring being spaced equidistant from each other, each hole being cut at an angle (18, 20) from center of the nozzle sufficient to give a swirling effect to the powder being shot from the nozzle.

10 Claims, 1 Drawing Sheet

POWER GUN SPRAY NOZZLE AND METHOD

TECHNICAL FIELD

The field of the invention is a powder spray gun nozzle and in particular the application of powder in and through an electrostatic powder gun.

BACKGROUND OF THE INVENTION

The application of dry powder coating to substrates has been utilized for many years. A way of applying dry powder is the utilization of electrostatic powder spraying technique. The electrostatic powder spray coating method comprises a combination of elements, namely a way of delivering the powder from a suitable supply to a position adjacent the article surface; a way of charging that powder to an electrical sign opposite to the surface so it will be attracted to it; a way of adhering the deposited particles to the surface; a way of fusing this powdered material so that it can flow into a suitable coating; and a way of accumulating or collecting the powder that escapes deposition so it will not become a contaminant but will be fit for reuse in subsequent coating operations.

In electrostatic powder spraying, charged powder in an air stream is directed toward the object to be coated so as to bring the powder adjacent the surface. Deposition generally results after the object has been exposed to the powder spray for a relatively short time. Manipulation of the part or the spray device exposes the various surfaces to the powder.

Alternative to an electrostatic technique is the application of powder in an air system. In the application of powdered plastic materials or powdered coating materials, a process similar to that used for dry enameling has come into use for forming plastic coatings. Basically, one heats the surface to be coated at a temperature above the melting point of the powder and while the substrate is at this temperature, distributing the powder over the surface. When the powder hits the surface, a portion of it will melt and adhere. Added powder will adhere with continuing application as the collected powder layer melts and becomes tacky. The part can then be post heated, if such is required, to flow or cure the powder layer.

See "Powder Coating"by Emery P. Miller et al., Society of Manufacturing Engineers, 1974, pp. 1–36.

In the application of powder to a substrate in particular by electrostatic powder spraying technique, the objective is to spread an air powder mixture into an even cone shape pattern without reducing the discharge of the powder stream and the effectiveness of the electrode. In addition, it is particularly helpful to be able to powder coat difficult to reach parts without the use of expensive masking such as stickers and tapes, which need to be applied by hand. Also, it would be particularly helpful in order to complete a coating of a part without having to dip the part in a separate liquid coating composition. Such treatments likewise require pollution control abatement systems to reduce emissions and require more maintenance.

It is particularly desirable to be able to have a powder coating application that would spread the air powder mixture in an even pattern onto he substrate.

It is an object of the present invention to apply the powder to he substrate in a swirling effect as it exits the tip of the spray gun.

SUMMARY OF THE INVENTION

Described is a powder gun spray nozzle comprising an nozzle capable of attaching to a powder spray gun having a center hole and an inner and an outer ring of spaced apart holes in the nozzle, each hole of the inner ring being spaced equidistant from each other and each hole of the outer ring being spaced equidistant from each other, each hole being cut at an angle from center of the nozzle sufficient to give a swirling effect to the powder being shot from the nozzle.

Also described is a method of applying powder to the substrate by swirling the powder from the spray gun nozzle as described above and recovering the coated substrate.

DESCRIPTION OF THE PREFERRED EMBODIMENT

The present invention is directed towards an improved powder gun spray nozzle. The powder gun is preferably an electrostatic powder spray gun, although an air spray gun likewise may be utilized.

Figure 1:
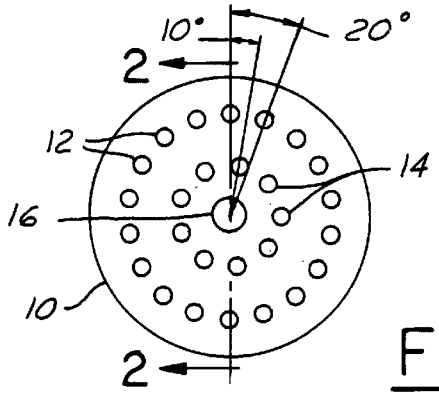
FIG. 1 is a front view of the nozzle of the present invention.

The nozzle may be made of any material that is capable of withstanding the chemical, physical and electrostatic activities required of a tip at the end of a spray gun. The purpose of the nozzle is to act as a tip diffuser. Its primary role is to spread an air/powder mixture into an even cone shape pattern without reducing the Coronna discharge of the powder stream and the effectiveness of the electrode. In a typical case the nozzle is designed for the application of powder so that the powder completely covers a 4–6 inch elliptical pattern from a distance of approximately 8 inches from the edge of the part. The electro deposition rate with the utilization of the present nozzle should not depart significantly from other typically application tips. Further, the nozzle of the present application may produce a pattern that can be adjusted radially. To adjust the amount of "swirling", the nozzle can be turned in the slot of the wear sleeve. A nominal 10° adjustment is possible. (See FIGS. 1 and 3.) The nozzle tip should be relatively inexpensive to produce.

In this fashion, the nozzle can be metallic or plastic, such as nylon. Typically the nozzle should fit within standard spray guns such as in "Nordson" Versa spray gun. Further, it is preferred that the nozzle not create maintenance problems due to wear problems or other issues relating to the production system, namely the application of powder to the desired substrate.

Figure 3:
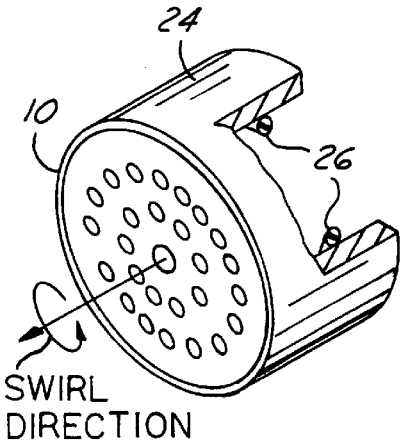
FIG. 3 is a partial cut-away isometric view of the nozzle plate of the present invention.

It has been found that the natural tendency of the powder as it exits the nozzle tip of the present invention is that it will swirl in a counterclockwise direction as viewed from front of gun (FIG. 3). This is due to the concentric holes that are present in the nozzle tip. This is a desirable effect due to the difficulty in applying powder to electrostatically shielded areas. This, in essence, provides for an end result which is similar to the oscillational movement of the spray gun as to the substrate.

Figure 2:
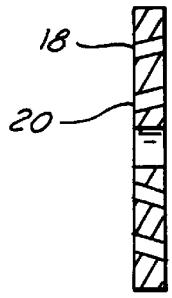
FIG. 2 is a side sectional view of the nozzle of the present invention taken along lines 2—2 of FIG. 1.

Turning now to a description of the parts as described in the drawings. The nozzle (10) of FIG. 1 has a dual ring of holes comprised of an outer ring of holes (12) and an inner ring of holes (14). The nozzle likewise has a central aperture (16). The holes are prepared at an angle from the X-axis of the nozzle as best shown in FIG. 2. Preferably, the angle of the holes (18) which is the outer ring are separated from each other approximately 15–30° most preferably 20° apart. The holes on the inner ring (20) are spaced approximately 10–20° from the center of the nozzle so that the angle ranges within 10–20°, most preferably 15° from the X-axis. The holes of the inner ring are separated from each other about 20–40°. The nozzle is generally of a size to fit at the end of the spray gun, namely at the tip and can vary in thickness; preferably it is approximately ¼ inch thick.

Figure 4:
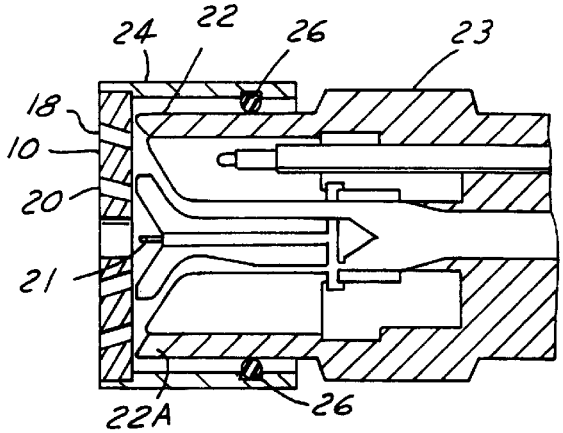
FIG. 4 is a side sectional view of an electrostatic spray gun with the nozzle of the present invention inserted at the output end of the spray gun.

Most preferably, the holes are cut 15° from the center of the nozzle; the holes of the inner ring are 40° apart and the holes of the outer ring are 20° apart. FIG. 3 shows the nozzle 10 in an isometric view. FIG. 4 shows the nozzle (10) at the tip of the cut away portion of the gun (23) with electrode 21. The nozzle cap is frictionally fit by notching extended member (22) and (22A). The nozzle fits within wear sleeve (24) which is mounted on a silicon O-ring (26).

The spray gun shown in FIG. 4 is the preferred technique, namely the use of electrostatic powder spray technique.

Figure 5:
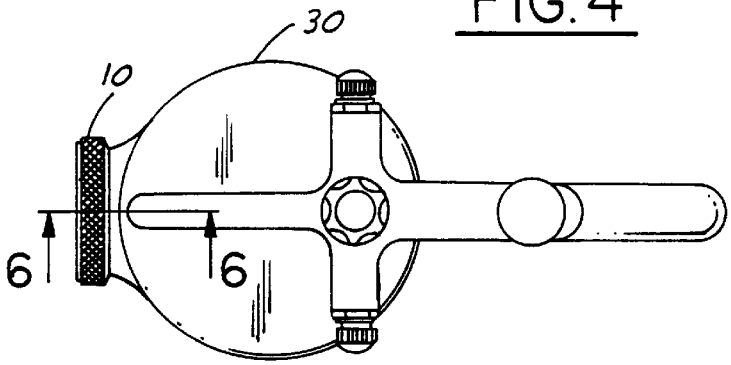
FIG. 5 is a top view of a powder spray gun where the nozzle of the present invention is inserted at the tip thereof.
Figure 6:
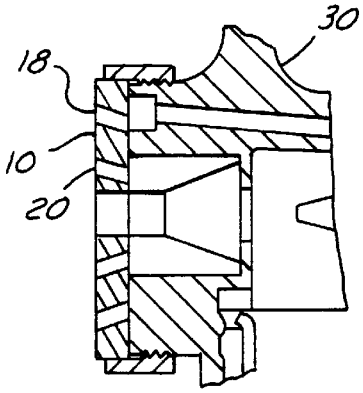
FIG. 6 is a side sectional view of a powder spray gun with the nozzle of the present invention inserted at the end from which the powder is sprayed, taken along lines 6—6 of FIG. 5.

FIG. 5 is an alternative technique wherein the nozzle (10) fits at the end of the spray gun (30) as best shown in FIG. 6. FIG. 5 is a top view of the spray gun (30) of FIG. 5. FIG. 6 is a cross-sectional view where the nozzle (10) fits within the gun (30).

A wide variety of powder materials can be sprayed from the gun such as acrylics, nylon, epoxy, urethane and the like. The substrates to which the powder can be applied can be metallic, plastic, as is well known in the automotive field.

While the forms of the invention herein disclosed constitute presently preferred embodiments, many others are possible. It is not intended herein to mention all of the possible equivalent forms or ramifications of the invention. It is understood that the terms used herein are merely descriptive, rather than limiting, and that various changes may be made without departing from the spirit or scope of the invention.

What is claimed is:

1. A powder gun spray nozzle plate comprising a nozzle plate capable of attaching to a powder spray gun having a center hole and an inner and an outer ring of spaced apart holes in the nozzle, each hole of the inner ring being spaced equidistant from each other and each hole of the outer ring being spaced equidistant from each other, each hole being cut at an angle of 10–20° from center of the nozzle sufficient to give a swirling effect to the powder being shot from the nozzle.

2. The nozzle of claim 1 wherein the angle of each hole is cut at an angle of less than 30° from the center of the nozzle.

3. The nozzle of claim 1 wherein the holes on the outer ring are separated from 15–30° from each other.

4. The nozzle of claim 1 wherein the holes of the inner ring are from 20–40° from each other.

5. The nozzle of claim 1 wherein the holes are cut about 15 degrees from the center of the nozzle; the holes of the inner ring are 40° apart and the holes of the outer ring are 20° apart.

6. A method of applying a powder coating to a substrate comprising:

providing a spray gun with a nozzle at the tip thereof;

spraying powder from the gun onto a substrate so that the powder is applied in a swirling fashion to the substrate; and recovering the coated substrate, wherein the nozzle is that of claim 1.

7. The method of claim 6 wherein each hole of the nozzle is cut at an angle of less than 30° from the center of the nozzle.

8. The method of claim 6 wherein the holes of the outer ring of the nozzle are from 15–30° from each other.

9. The method of claim 6 wherein the holes of the inner ring of the nozzle are from 20–40° from each other.

10. The method of claim 6 wherein the holes of the nozzle are cut about 15° from the center of the nozzle; the holes of the inner ring are 40° apart and the holes of the outer ring are 20° apart.

* * * * *